US007125655B2

(12) United States Patent
Mun et al.

(10) Patent No.: US 7,125,655 B2
(45) Date of Patent: Oct. 24, 2006

(54) FABRICATING METHOD OF PLASMA DISPLAY PANEL

(75) Inventors: Byung Jun Mun, Daegu-kwangyeokshi (KR); Soon Hak Kim, Kyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/830,015

(22) Filed: Apr. 23, 2004

(65) Prior Publication Data

US 2004/0214111 A1 Oct. 28, 2004

(30) Foreign Application Priority Data

Apr. 25, 2003 (KR) ..... P10-2003-0026400

(51) Int. Cl.
*H01J 9/02* (2006.01)

(52) U.S. Cl. ..... 430/319; 430/321; 445/24

(58) Field of Classification Search ..... 430/319, 430/321; 445/24; 313/582, 584
See application file for complete search history.

(56) References Cited

U.S. PATENT DOCUMENTS 6,156,433 A * 12/2000 Hatori et al. ..... 428/411.1
2003/0090204 A1* 5/2003 Joo et al. ..... 313/582

FOREIGN PATENT DOCUMENTS

| | | |
|---|---|---|
| JP | H09-306341 | 11/1997 |
| JP | 2002-150955 | 5/2002 |
| JP | 2002-367509 A * | 12/2002 |

* cited by examiner

*Primary Examiner*—John A. McPherson
(74) *Attorney, Agent, or Firm*—Fleshner & Kim LLP

(57) ABSTRACT

There is disclosed a fabricating method of a plasma display panel which might simplify its fabricating process. The method includes: providing a sheet into which a black material layer and an electrode material layer are integrated, forming the sheet on a substrate, aligning a first mask on the front surface of a substrate where the sheet has been formed and exposing the sheet, aligning a second mask on the rear surface of the substrate and exposing the sheet, and developing the exposed sheet to form a bus electrode and a light shielding layer.

20 Claims, 18 Drawing Sheets

FABRICATING METHOD OF PLASMA DISPLAY PANEL

This application claims the benefit of the Korean Patent Application No. P2003-26400 filed on Apr. 25, 2003, which is hereby incorporated by reference.

BACKGROUND OF THE INVENTION

1. Field of the Invention

The present invention relates to a fabricating method of a plasma display panel, and more particularly to a fabricating method of a plasma display panel which might simplify the fabricating process of a substrate.

2. Description of the Related Art

Recently, Flat Panel Displays have briskly been developed, which include Liquid Crystal Displays (hereinafter 'LCD'), Field Emission Displays (hereinafter 'FED'), Plasma Display Panels (hereinafter 'PDP'). The PDP among them has advantages of easy production due to its simple structure, excellence of high brightness and high light-emission efficiency, memory function, and wide viewing angle of over 160°, in addition, being realized into a large screen of over 40 inches.

FIG. 1 is a diagram representing a discharge cell of a three-electrode AC surface discharge PDP of prior art.

Referring to FIG. 1, the discharge cell includes a scan/sustain electrode 34Y and a common sustain electrode 34Z formed on an upper substrate 46 and an address electrode 32X formed on a lower substrate 44. The lower substrate 44 is shown by being rotated in a 90 degree arc.

The sustain electrode pair 34Y, 34Z includes a transparent electrode 34A and a bus electrode 34B. The bus electrode 34B has a double layer structure of a black material layer 34I and an electrode material layer 34J.

An upper dielectric layer 42 and a protective film 40 are deposited on the upper substrate 46 on which the scan/sustain electrode 34Y and the common sustain electrode 34Z are formed in parallel. Wall charges being generated upon plasma discharge are accumulated in the upper dielectric layer 42.

The protective film 40 increases the discharge efficiency of secondary electron as well as protects the upper dielectric layer 42 from being damaged by the sputtering generated upon plasma discharge. The protective film 40 is usually magnesium oxide MgO.

A lower dielectric layer 48 and barrier ribs 38 are formed on the lower substrate where the address electrode 32X is formed. A phosphorus layer 36 is spread over the surface of the lower dielectric layer 48 and the barrier ribs 38. The address electrode 32X is formed in a direction of crossing the scan/sustain electrode 34Y and the common sustain electrode 34Z.

The barrier ribs 38 is formed along the address electrode 32X in parallel to prevent ultraviolet rays and visible rays from leaking into adjacent discharge cells, wherein the ultraviolet rays and visible rays are formed by discharge.

Any one of red R, green G or blue B visible rays is generated in the phosphorus layer 36, wherein the generated visible ray is excited by the ultraviolet ray generated upon plasma display. Inert gas is injected for gas discharge into a discharge space provided between the upper substrate 46, the lower substrate 44 and the barrier ribs 38.

A black matrix 52 is formed along the sustain electrode pair 34Y, 34Z on the upper dielectric layer 42 of such a PDP in order to improve the contrast of screen.

The black matrix 52 absorbs an external light being between and the transmitted light inside adjacent discharge cells, thus the improvement of its chroma and contrast can be made. Also, the black matrix 52 should be black because it is a visible light absorbing body.

The black matrix 52 is formed by a printing method or a photo-sensitivity method to be around 5 μm in height, wherein photosensitive resin, solvent and metal such as ruthenium Ru and Cobalt Co on a PbO group glass of low temperature which has its usual transition point below 400° C.

FIGS. 2A to 2G are diagrams representing a fabricating method of an upper substrate of a plasma display panel according to prior art.

Firstly, the transparent electrode 34A is formed, as shown in FIG. 2A, by patterning after depositing transparent conductive material on the upper substrate 46. The black material layer 34I with low conductivity is printed and then dried, as shown in FIG. 2B, in order to cover the transparent electrode 34A on the upper substrate 46 where the transparent electrode 34A is formed. Subsequently, the black material layer 61 corresponding to a transmitting part 60B is exposed by use of a first photo mask 60 having a shielding part 60A and a transmitting part 60B on the black material layer 34I, as shown in FIG. 2C.

Subsequently, the electrode material layer 34J is printed on the upper substrate 46 and then dried, as shown in FIG. 2D, wherein the partially exposed black material layer 34I has been formed on the upper substrate 46. And then, the black material layer 34I and the electrode material layer 34J overlapping with the transmitting part 7DB are exposed by use of a second photo mask 70 having a shielding part 70A and a transmitting part 70B, as shown in FIG. 2E. The exposed black material layer 34I and the electrode material layer 34J are is patterned by a development process and then go through a firing process to form the bus electrode 34B and the black matrix 52, as shown in FIG. 2F. Herein, the bus electrode 34B has a two layer structure of the black material layer 34I and the electrode material layer 34J, and the black matrix 52 has a single layer structure of the black material layer 34I.

The upper dielectric layer 42 is formed, as shown in FIG. 2G, by spreading a dielectric material over the upper substrate 46 where the sustain electrode pair 34Y, 34Z and the black matrix 52 are formed.

Then, the protective film 40 is formed, as shown in FIG. 2H, by spreading magnesium oxide over the upper dielectric layer 42, wherein the magnesium oxide is a protective material.

However, upon the fabricating process of the upper plate of a prior art PDP, there occurs a problem that impurities including dust in the air are mixed into each material layer in several processes such as the printing and drying of the black material layer 34I and the printing and drying of the electrode material layer 34J. Also, a few mask processes are required in order to form the upper plate of the prior art PDP. Especially, at least two mask processes including exposure process and development process are required to form the bus electrode and the black matrix, thus there occurs a problem that the process becomes complex and the process time lengthen.

SUMMARY OF THE INVENTION

Accordingly, it is an object of the present invention to provide a fabricating method of a plasma display panel which might simplify the fabricating process of a substrate.

In order to achieve these and other objects of the invention, a fabricating method of a plasma display panel according to an aspect of the present invention includes the steps of providing a sheet into which a black material layer and an electrode material layer are integrated; forming the sheet on a substrate; aligning a first mask on the front surface of a substrate where the sheet has been formed and exposing the sheet; aligning a second mask on the rear surface of the substrate and exposing the sheet; and developing the exposed sheet to form a bus electrode and a light shielding layer.

In the fabricating method, the step of developing the exposed sheet includes the step of developing the black matrix and the electrode material layer at the same time.

In the fabricating method, the exposure using the first mask is made by use of an ultraviolet ray of around 200~800 mmJ/cm$^3$.

In the fabricating method, the exposure using the second mask is made by use of an ultraviolet ray of around 400~1000 mmJ/cm$^3$.

In the fabricating method, the bus electrode is formed of the black material layer and the electrode material layer.

In the fabricating method, the black material layer includes at least one of ruthenium Ru and Cobalt Co of 50~60%, solvent of 20~30% and photosensitive resin of 25~35%.

In the fabricating method, the electrode material layer includes silver Ag of 50~60%, solvent of 20~30% and photosensitive resin of 25~35%.

The fabricating method further includes the steps of: forming a dielectric body on the substrate on which the bus electrode and the black matrix have been formed; and forming a protective film on the substrate on which the dielectric body has been formed.

In the fabricating method, the step of providing the sheet includes the step of joining the black material layer with the electrode material layer in a laminating process.

In the fabricating method, the step of forming the sheet on the substrate includes the step of joining the substrate with the sheet in a laminating process.

A fabricating method of a plasma display panel according to another aspect of the present invention includes providing a sheet into which a black material layer and an electrode material layer are integrated; forming the sheet on a substrate; aligning a first mask and a second mask on the front surface and the rear surface of a substrate where the sheet has been formed, respectively; and exposing the sheet by use of the first and second masks and developing the sheet to form a bus electrode and a light shielding layer.

In the fabricating method, the step of forming the bus electrode and the light shielding layer includes the steps of exposing the electrode material layer and the black material layer of the sheet by use of the first mask, and at the same time exposing the black material layer of the sheet by use of the second mask; and developing the black material layer and the electrode material layer of the exposed sheet simultaneously.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
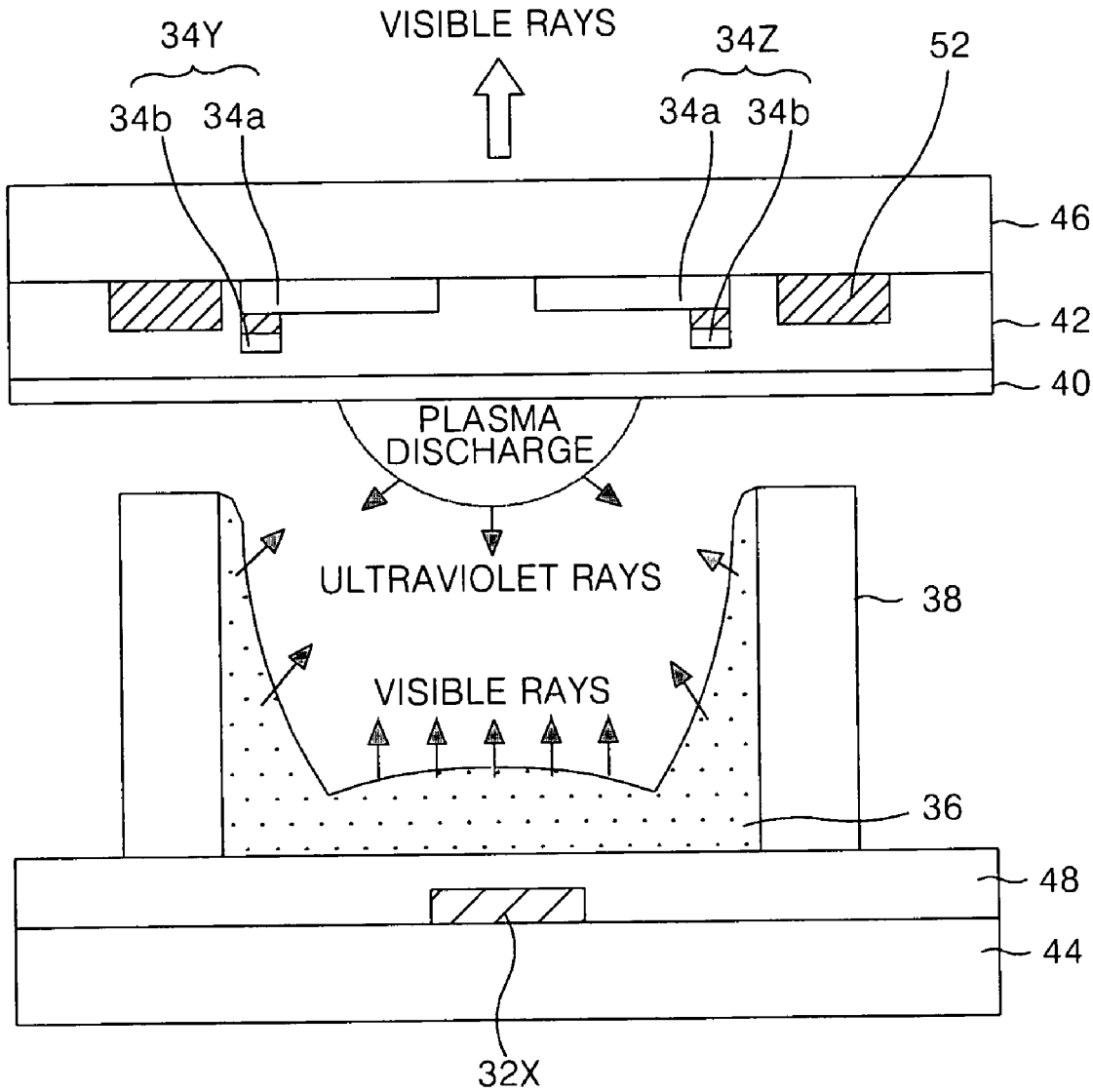
FIG. 1 RELATED ART
FIG. 1 is a sectional diagram representing a discharge cell structure of a three-electrode AC surface discharge PDP of prior art.
Figure 2A:
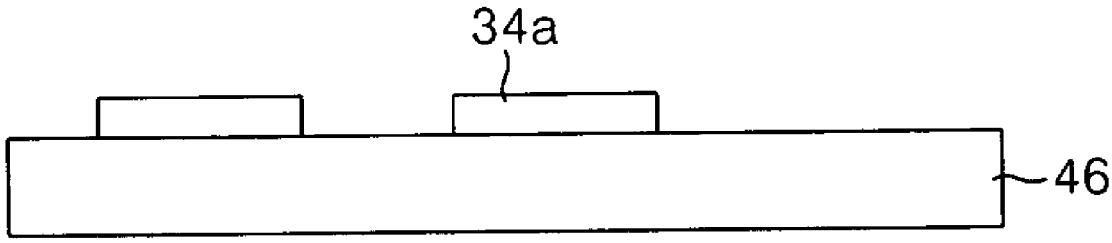
FIG. 2A RELATED ART
FIGS. 2A to 2H are sectional diagrams representing a fabricating method of an upper plate of the plasma display panel of prior art by stages.
Figure 2B:
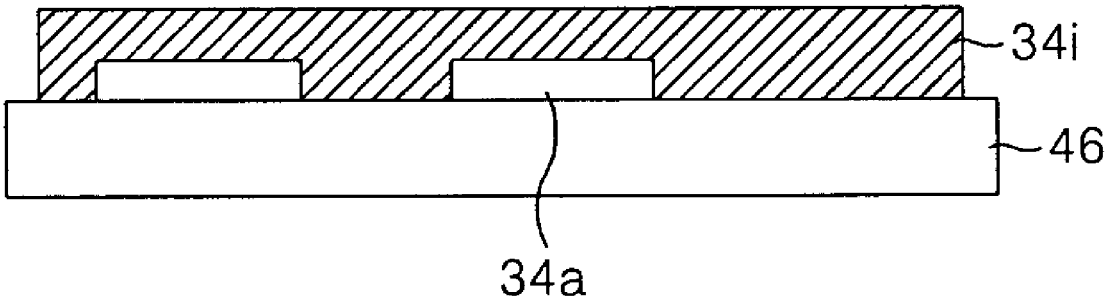
FIG.2B RELATED ART
Figure 2C:
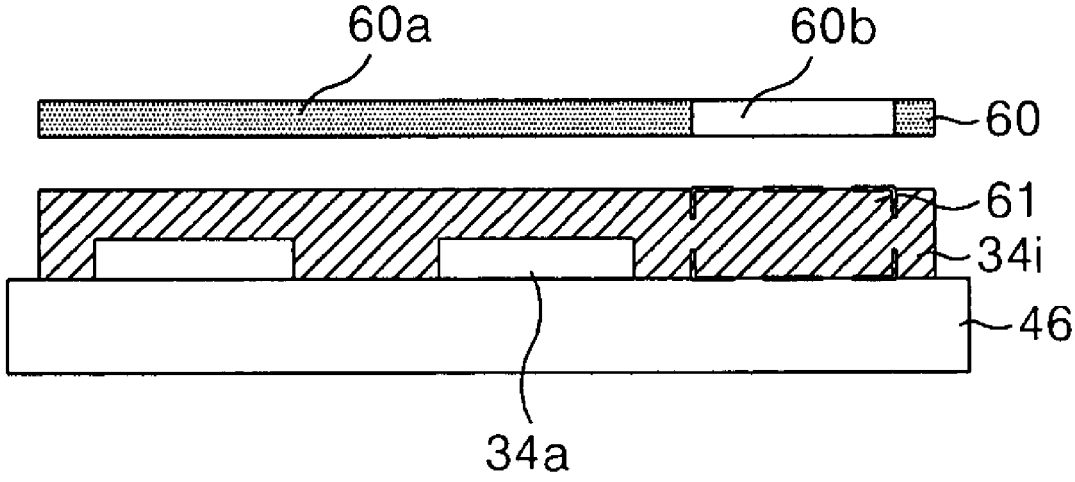
FIG. 2C RELATED ART
Figure 2D:
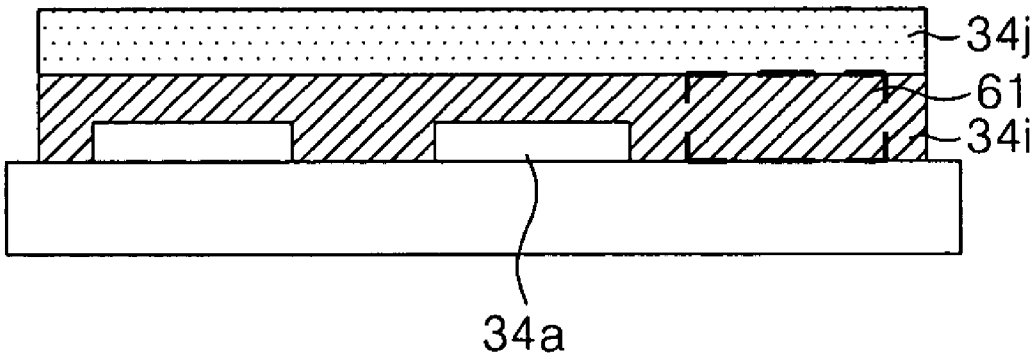
FIG.2D RELATED ART
Figure 2E:
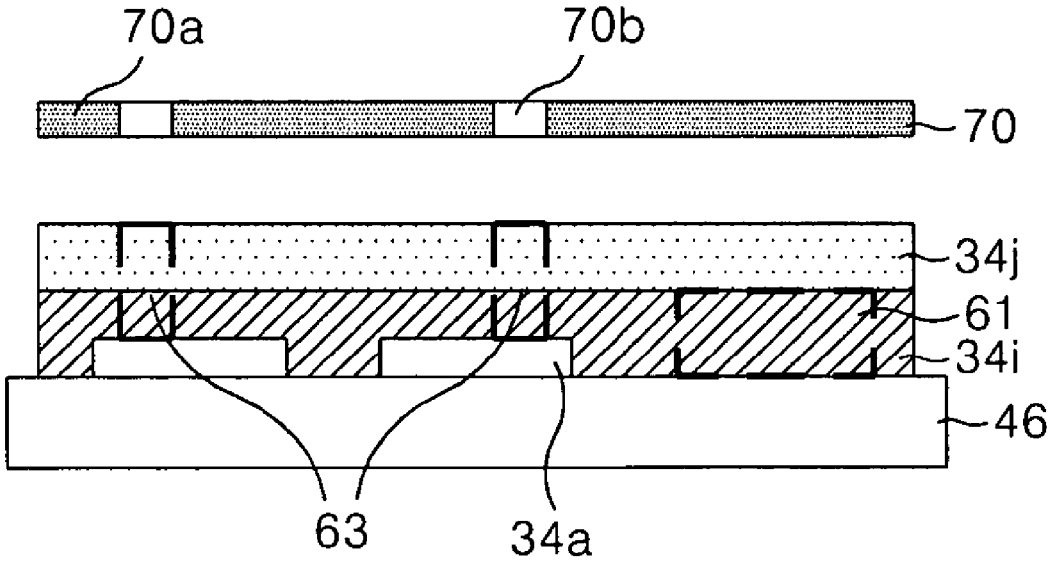
FIG. 2E RELATED ART
Figure 2F:
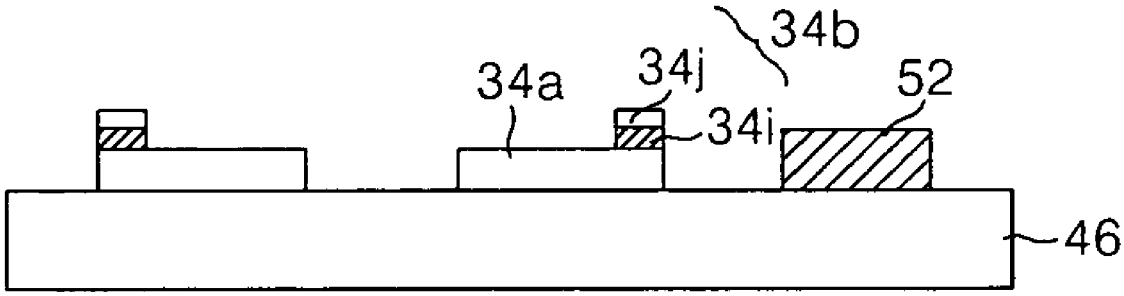
FIG. 2F RELATED ART
Figure 2G:
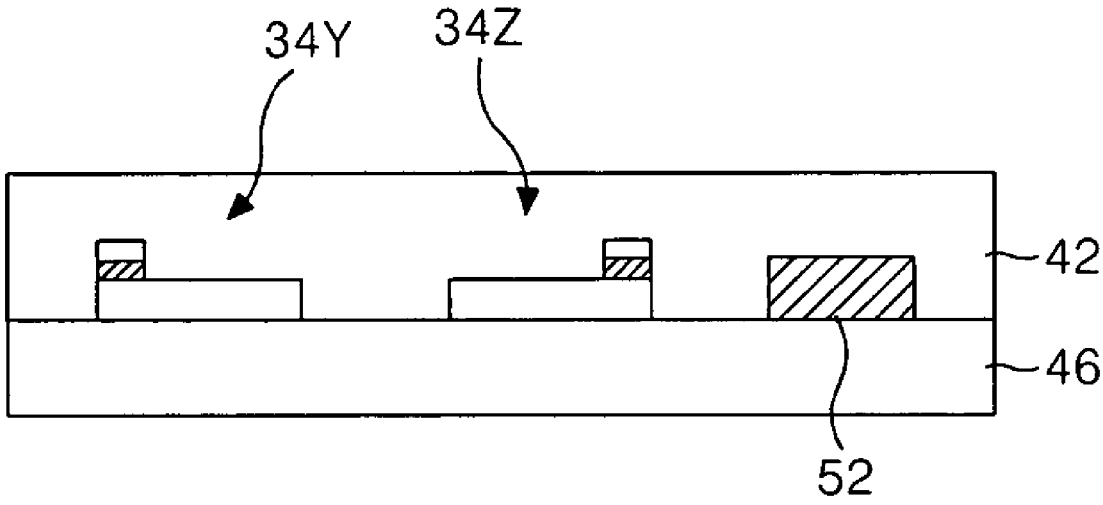
FIG.2G RELATED ART
Figure 2H:
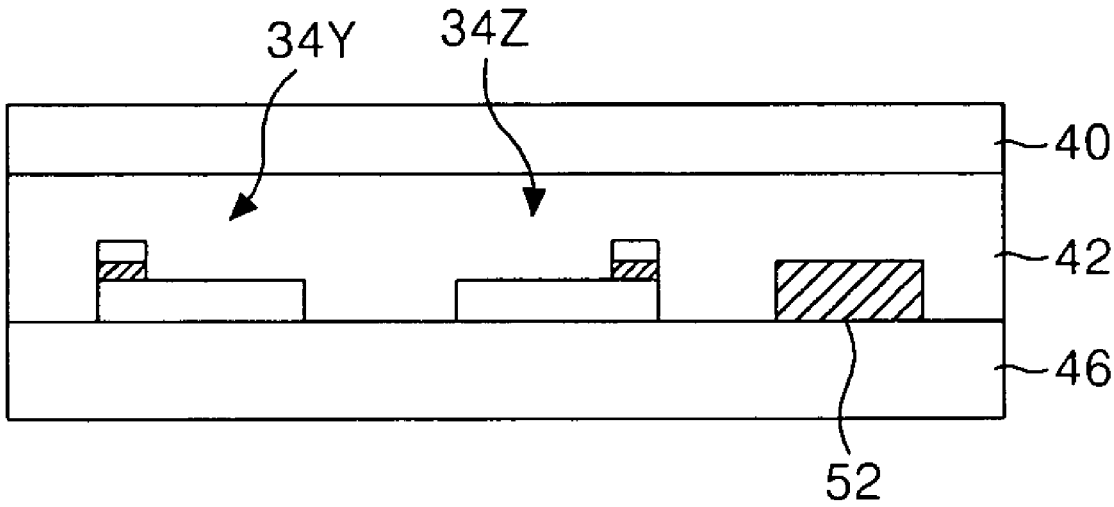
FIG. 2H RELATED ART
Figure 3A:
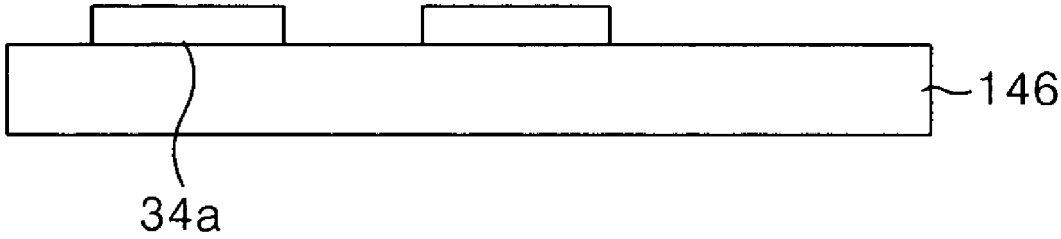
FIGS. 3A to 3G are sectional diagrams representing a fabricating method of an upper plate of a plasma display panel according to the present invention by stages.
Figure 3B:
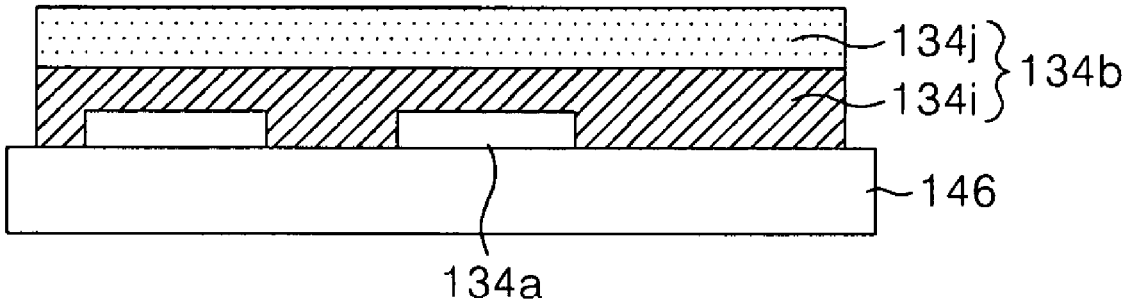
Figure 3C:
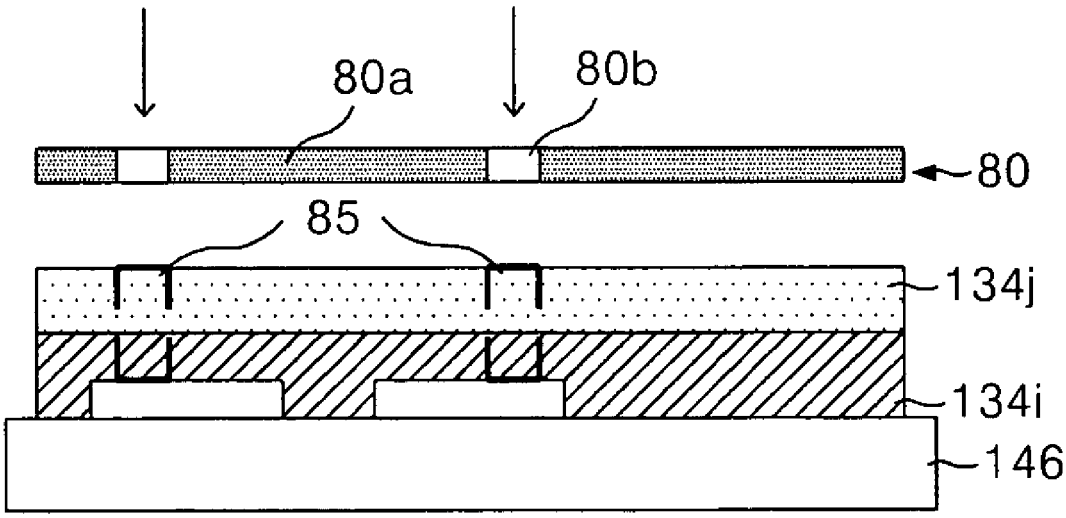
Figure 3D:
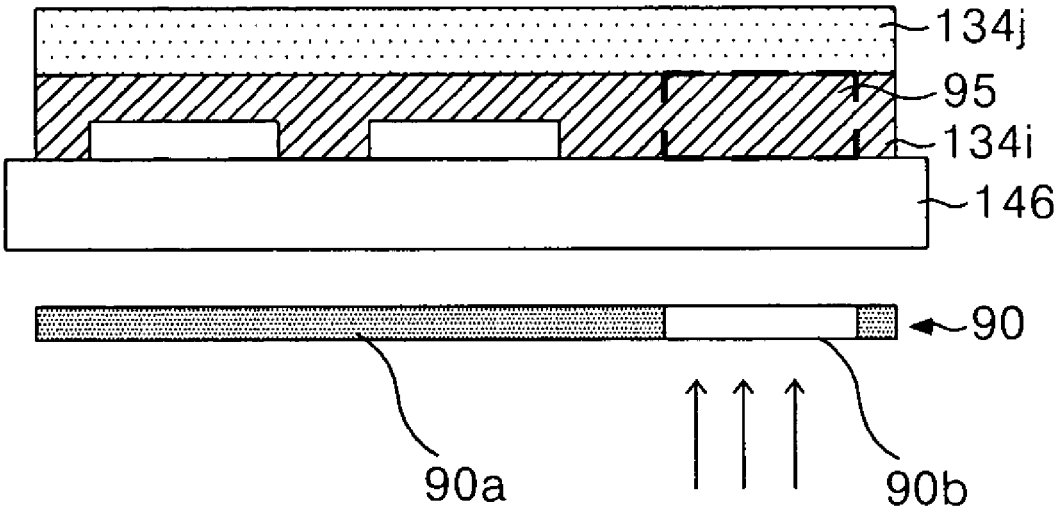
Figure 3E:
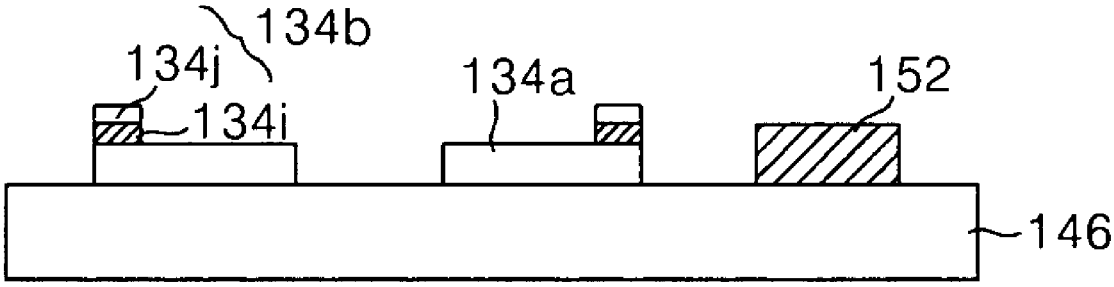
Figure 3F:
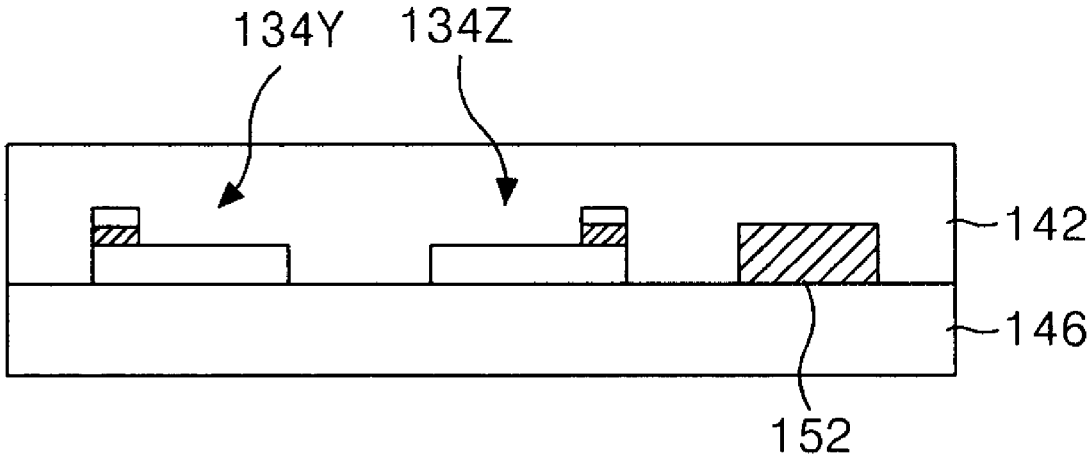
Figure 3G:
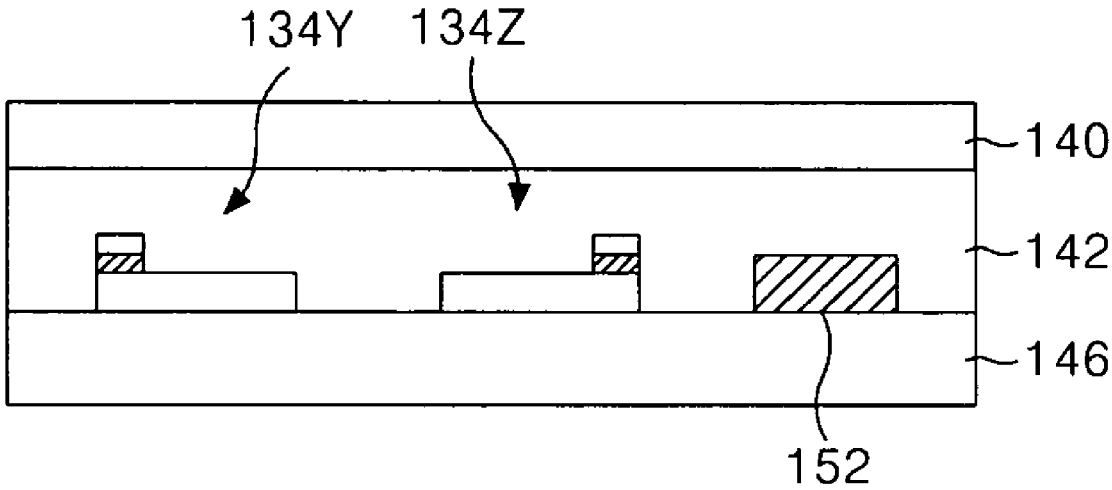
Figure 4:
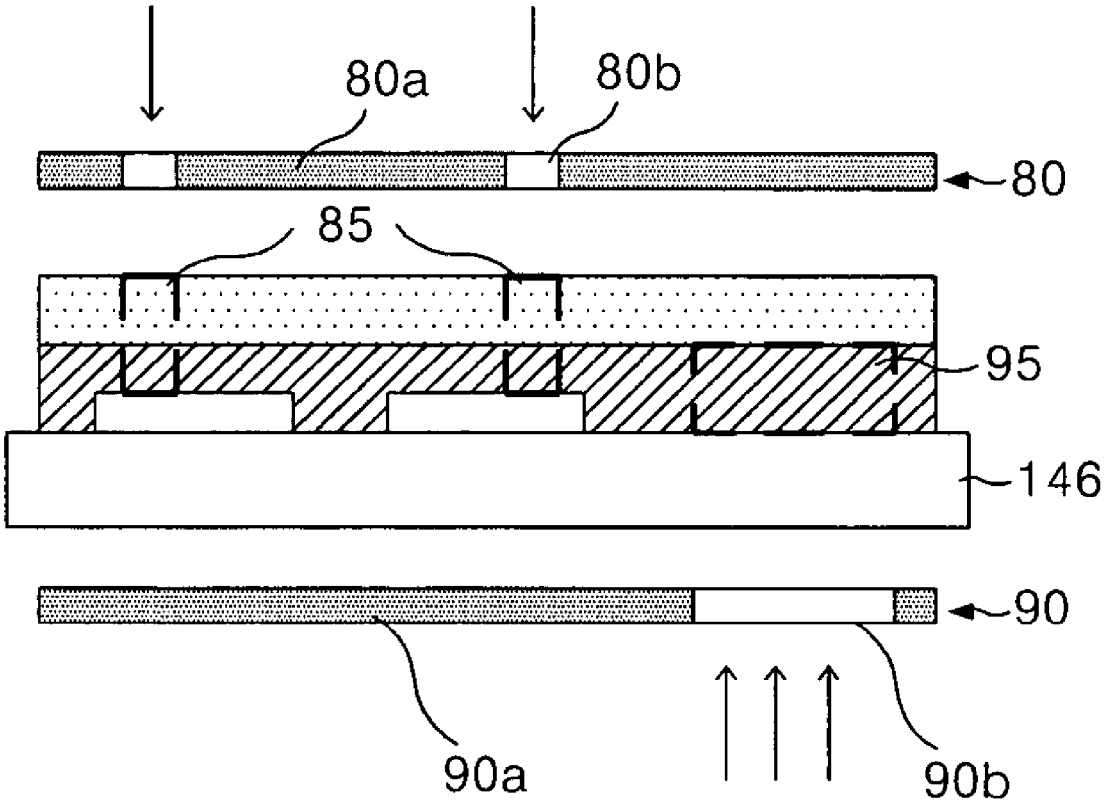
FIG. 4 is a diagram representing the concurrent implementation of an exposure process after aligning masks in the front surface and rear surface of a substrate respectively.
Figure 5:
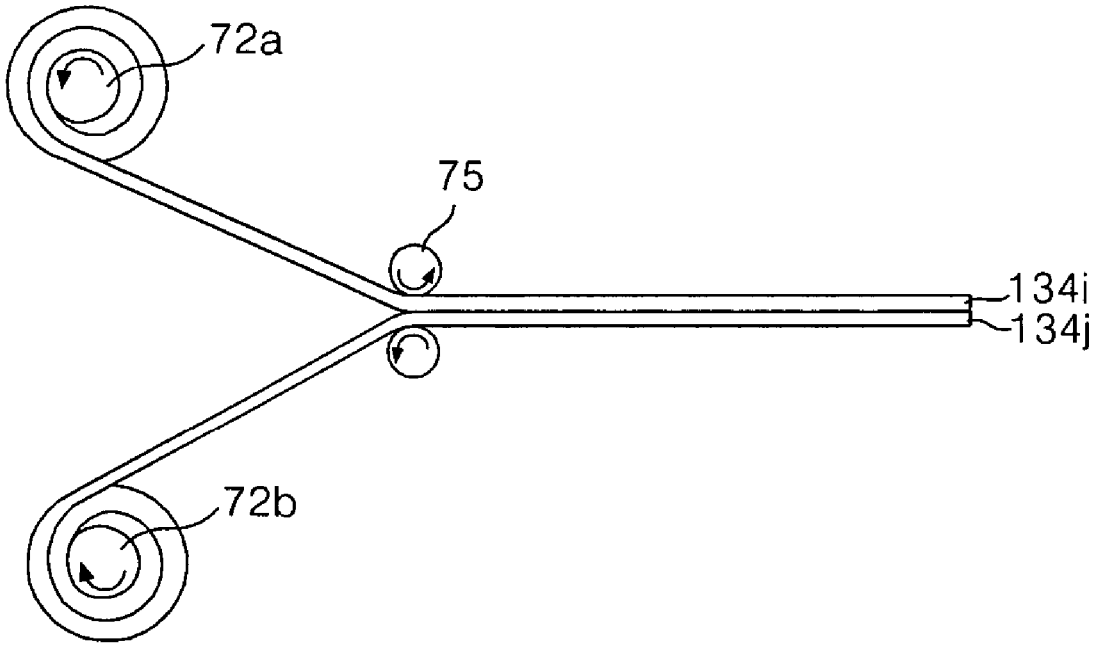
FIG. 5 is a diagram representing a laminating process of a black material layer and an electrode material layer.

With reference to FIGS. 3 to 5, embodiments of the present invention will be explained as follows.

FIGS. 3A to 3G are diagrams representing a fabricating method of an upper plate of a plasma display panel according to the present invention.

Firstly, transparent conductive material is deposited on an upper substrate 146, and then is patterned to form transparent electrode 134A on the upper substrate 146, as shown in FIG. 3A. A unitary sheet 134B into which a black material layer 134I and an electrode material layer 134J are integrated is formed to cover the transparent electrode 134A, as shown in FIG. 3B, wherein the black material layer 134I and the electrode material layer 134J are made in separate processes.

The black material layer 134I and the electrode material layer 134J are made in the same composition as the following table 1 and 2.

TABLE 1

| Composition of electrode material layer | Ru or Co | Solvent | Photosensitive resin |
|---|---|---|---|
| Content | 50~60% | 20~30% | 25~35% |

TABLE 2

| Composition of electrode material layer | Ag | Solvent | Photosensitive resin |
|---|---|---|---|
| Content | 50~60% | 20~30% | 25~35% |

The unitary sheet 134B is laminated on the upper substrate 146, on which the transparent electrode 134A has been formed, with the temperature of around 50~80° C. and the pressure of around 1.5 kgf/cm$^2$.

Subsequently, as shown in FIG. 3C, a first photo-mask 80 having a shielding part 80A and a transmitting part 80B is aligned on the front surface of the upper substrate 146 where the unitary sheet 134B has been formed, and then the black material layer 134I and the electrode material layer 134J overlapping with the transmitting part 80B is exposed by ultraviolet ray of 200~800 mmJ/cm$^3$. Herein, the transmitting part 80B of the first photo-mask 80 overlaps with an area 85 in which a bus electrode is to be formed later on.

Subsequently, as shown in FIG. 3*d*, a second photo-mask 90 having a shielding part 90A and a transmitting part 90B is aligned on the rear surface of the upper substrate 146, and then the black material layer 134I of an area 95 overlapping with the transmitting part 90B is exposed by ultraviolet ray of 400~1000 mmJ/cm$^3$. Herein, the transmitting part 90B of the second photo-mask 90 overlaps with an area 95 in which a black matrix is to be formed later on.

Subsequently, the unitary sheet 134B is patterned by one time of development process and then goes through a firing process to from the bus electrode 134B and the black matrix 152, as shown in FIG. 3E. Herein, the bus electrode 134B has a double layer structure of the black material layer 134I and the electrode material layer 134J and is formed on the transparent electrode 134A. And the black matrix 152 has a single layer structure of the black material layer 134I and is formed on the upper substrate 146.

A dielectric material is spread over the upper substrate 146 where the black matrix 152 and the scan/sustain electrode and the common sustain electrode 134Y, 134Z are formed to make a upper dielectric layer 142 formed, as shown in FIG. 3F, wherein the scan/sustain electrode and the common sustain electrode each have the transparent electrode 134A and the bus electrode 134B.

And then, magnesium oxide MgO is spread over the upper dielectric layer 142 to form a protective film 140, as shown in FIG. 3G.

On the other hand, the processes shown in FIGS. 3C and 3D might be implemented like a process shown in FIG. 4 where masks are aligned on the front surface and the rear surface of the substrate respectively, and then an exposure process is conducted simultaneously.

FIG. 5 is a diagram explaining a process of forming a unitary sheet by a laminating process.

The black material layer 134I wound on a first roller 72A and the electrode material layer 134B wound on a second roller 72B are pressurized and drawn out by a compressing roller 75, and at the same time, it is heated by a heater (not shown). Upon such a laminating process, its temperature is around 70~90° C. and its pressure is around 3~4 kg/cm$^2$.

In this way, the PDP according to the present invention might be able to shorten the number of times of development process to one time or the number of times of exposure process to one time when comparing with prior art, thereby reducing its mingling with impurities generated in several processes as well as simplifying its production process.

As described above, in the fabricating method of the plasma display panel according to the present invention, its fabricating process is simplified by forming the black matrix and bus electrode in one time of development process of the unitary sheet where the manufactured black material layer and electrode material layer are unified. Also, the simplified fabricating process prevents its device property from being deteriorated by impurities which include dust in the air and so on.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A fabricating method of a plasma display panel, comprising:

providing a sheet into which a black material layer and an electrode material layer are integrated;

forming the sheet on a substrate;

aligning a first mask on the front surface of a substrate where the sheet has been formed and exposing the sheet;

aligning a second mask on the rear surface of the substrate and exposing the sheet; and developing the exposed sheet to form a bus electrode and a light shielding layer.

2. The fabricating method according to claim 1, wherein developing the exposed sheet includes:

developing the black material layer and the electrode material layer at the same time.

3. The fabricating method according to claim 2, wherein the exposure using the first mask is made by use of an ultraviolet ray of around 200~800 mmJ/cm$^3$.

4. The fabricating method according to claim 2, wherein the exposure using the second mask is made by use of an ultraviolet ray of around 400~1000 mmJ/cm$^3$.

5. The fabrication method according to claim 2, wherein the light shielding layer is formed from the black material layer.

6. The fabricating method according to claim 1, wherein the bus electrode is formed of the black material layer and the electrode material layer.

7. The fabricating method according to claim 6, wherein the black material layer includes ruthenium Ru and Cobalt Co of 50~60%, solvent of 20~30% and photosensitive resin of 25~35%.

8. The fabricating method according to claim 6, wherein the electrode material layer includes silver Ag of 50~60%, solvent of 20~30% and photosensitive resin of 25~35%.

9. The fabricating method according to claim 1, further comprising:

forming a dielectric body on the substrate on which the bus electrode and the light shielding layer have been formed; and forming a protective film on the substrate on which the dielectric body has been formed.

10. The fabricating method according to claim 1, wherein providing the sheet includes:

joining the black material layer with the electrode material layer in a laminating process.

11. The fabricating method according to claim 1, wherein forming the sheet on the substrate includes:

joining the substrate with the sheet in a laminating process.

12. The fabrication method according to claim 1, wherein the light shielding layer is formed from a portion of the black material layer.

13. A fabricating method of a plasma display panel, comprising:

providing a sheet into which a black material layer and an electrode material layer are integrated;

forming the sheet on a substrate;

aligning a first mask and a second mask on the front surface and the rear surface of a substrate where the sheet has been formed, respectively; and exposing the sheet by use of the first and second masks and developing the sheet to form a bus electrode and a light shielding layer.

14. The fabricating method according to claim 13, wherein forming the bus electrode and the light shielding layer includes:

exposing the electrode material layer and the black material layer of the sheet by use of the first mask, and at the same time exposing the black material layer of the sheet by use of the second mask; and developing the black material layer and the electrode material layer of the exposed sheet simultaneously.

15. A plasma display panel fabricating method, comprising:

attaching a prefabricated layer to a substrate, wherein the prefabricated layer comprises a black material layer and an electrode layer;

aligning a first mask on a front surface of a substrate, and aligning a second mask on a rear surface of the substrate;

exposing the prefabricated layer using the first and second masks;

developing the prefabricated layer;

forming at least one electrode using the black material and electrode layers of the prefabricated layer, wherein the electrode is formed by exposing the prefabricated layer through the first mask on the front surface of the substrate; and forming at least one black matrix using the black material of the prefabricated layer, wherein the black matrix is formed by exposing the prefabricated layer through the second mask on the rear surface of the substrate.

16. The method of claim 15, wherein the black material layer includes ruthenium Ru and cobalt Co of 50~60%, solvent of 20~30% and photosensitive resin of 25~35%.

17. The method of claim 15, wherein the electrode layer includes silver Ag of 50~60%, solvent of 20~30% and photosensitive resin of 25~35%.

18. The method of claim 15, wherein the prefabricated layer is attached to the substrate with temperature around 50~80° C. and pressure around 1.5 $Kg/cm^2$.

19. The method of claim 15, wherein the prefabricated layer is formed by laminating the black material layer and the electrode layer.

20. The method of claim 19, wherein the lamination occurs in temperature around 70~90° C. and pressure around 3~4 $Kg/cm^2$.

* * * * *